US010043457B2

(12) United States Patent
Kirk

(10) Patent No.: US 10,043,457 B2
(45) Date of Patent: Aug. 7, 2018

(54) VARIABLE BRIGHTNESS LCD BACKLIGHT

(75) Inventor: David B. Kirk, Telluride, CO (US)

(73) Assignee: NVIDIA CORPORATION, Santa Clara, CA (US)

( * ) Notice: Subject to any disclaimer, the term of this patent is extended or adjusted under 35 U.S.C. 154(b) by 2174 days.

(21) Appl. No.: 12/388,443

(22) Filed: Feb. 18, 2009

(65) Prior Publication Data

US 2009/0146944 A1 Jun. 11, 2009

Related U.S. Application Data

(63) Continuation of application No. 11/045,239, filed on Jan. 27, 2005, now Pat. No. 7,502,010.

(60) Provisional application No. 60/606,392, filed on Aug. 31, 2004.

(51) Int. Cl.
*G09G 3/34* (2006.01)

(52) U.S. Cl.
CPC ... *G09G 3/3413* (2013.01); *G09G 2320/0646* (2013.01); *G09G 2330/021* (2013.01); *G09G 2360/16* (2013.01)

(58) Field of Classification Search
CPC ..... G09G 3/3406; G09G 2320/062
USPC ..... 345/102, 77, 87, 690
See application file for complete search history.

(56) References Cited

U.S. PATENT DOCUMENTS

| | | | | |
|---|---|---|---|---|
| 6,097,836 | A * | 8/2000 | Inoue | 382/165 |
| 6,111,559 | A | 8/2000 | Motomura et al. | |
| 6,229,544 | B1 * | 5/2001 | Cragun | 345/418 |
| 6,417,833 | B1 * | 7/2002 | Takemoto | 345/102 |
| 6,496,236 | B1 * | 12/2002 | Cole et al. | 349/61 |
| 6,678,534 | B2 * | 1/2004 | Ishigaki | 455/556.1 |
| 6,974,229 | B2 * | 12/2005 | West et al. | 362/227 |
| 7,154,468 | B2 * | 12/2006 | Linzmeier et al. | 345/102 |
| 2002/0171617 | A1 * | 11/2002 | Fuller | 345/102 |
| 2004/0239580 | A1 * | 12/2004 | Nagatani et al. | 345/1.3 |
| 2006/0145887 | A1 * | 7/2006 | McMahon | 340/815.45 |

FOREIGN PATENT DOCUMENTS

| | | |
|---|---|---|
| EP | 0730371 | 9/1996 |
| JP | 2002-099250 | 4/2002 |
| JP | 2004-191490 | 7/2004 |
| WO | WO 03091791 | 11/2003 |

OTHER PUBLICATIONS

English translation of JP 2004-191490, provided as explanation of relevance.
English translation of JP 2002-099250, provided as explanation of relevance.

* cited by examiner

*Primary Examiner* — William Boddie
(74) *Attorney, Agent, or Firm* — Artegis Law Group, LLP

(57) ABSTRACT

A display for a computer system, such as an LCD, is configured to consume less power when compared to conventional designs. The display includes a screen and at least one backlight configured to illuminate the screen. An input to the at least one backlight is adjustable to produce a desired level of brightness. The input may be computed based on a generated source image and a defined constraint. An input to the display is computed based on the input to the at least one backlight and the source image. The input to the display modifies the level of brightness provided by the at least one backlight to produce a viewable image.

21 Claims, 3 Drawing Sheets

VARIABLE BRIGHTNESS LCD BACKLIGHT

CROSS-REFERENCE TO RELATED APPLICATIONS

This application is a continuation of U.S. patent application Ser. No. 11/045,239, filed Jan. 27, 2005, which relates to and claims the priority benefit of U.S. Provisional Patent Application No. 60/606,392, filed on Aug. 31, 2004. The subject matter of these related applications is hereby incorporated by reference.

BACKGROUND OF THE INVENTION

Field of the Invention

One or more embodiments of the present invention generally relate to backlit displays and, more particularly, to reducing power consumption of backlit displays.

Description of the Related Art

Liquid crystal display (LCD) screens, such as the ones used in notebook computers or electronic handheld games, are commonly backlit to make them easier to read. FIG. 1 illustrates an exemplary backlit LCD 100 that includes a core of LCD material 102 between sheets of glass 104 and 106. A backlight source 108 produces light to illuminate the LCD material 102. As illustrated by the arrows, light produced by backlight source 108 is generally diffuse, with components traveling in different directions. The light from backlight source 108 typically passes through a polarizer 110 that blocks light that is not aligned with an axis of polarization of polarizer 110. The light that is aligned with the axis of polarization is allowed to pass through the polarizer 110 to reach the LCD material 102.

The LCD material 102 has electro-optic properties that causes the polarized light that passes through the LCD material 102 to twist. This twisting may be controlled by applying a voltage waveform to the LCD material 102 for each pixel in an array of pixels. Typically, an electronic circuit that controls the array of pixels operates by accepting a digital control value for each pixel in the array of pixels. The control circuit will apply a voltage waveform to the LCD material 102 for a pixel based on the digital control value for the pixel. Generally, the control circuit is configured so that smaller digital control values result in application of a voltage waveform that causes the LCD material 102 to twist the light in such a way that more of the light is blocked by the second polarizer 112, thereby causing the pixel to appear darker. Conversely, larger digital control values result in application of a voltage waveform which causes the LCD material 102 to twist the light in such a way that less of the light is blocked by the second polarizer 112, thereby causing the pixel to appear brighter.

From a power consumption standpoint, conventional LCD backlighting may be far from efficient. Typically, the backlight source 108 illuminates all the pixels in the LCD 100 simultaneously with a relatively constant brightness across all pixels. As previously described, to dim parts of the LCD, a voltage waveform is applied to rows and columns of electrodes supported on the glass substrates 104, 106 that causes the LCD material 102 to twist in a way that results in more of the light generated by the back light source 108 to be blocked. Dimming parts of the LCD in this fashion essentially "wastes" a certain amount of the illumination provided by the backlight source 108 since the backlight source 108 produces the same level of brightness regardless of how much dimming occurs on the screen from the voltage waveform. There are many circumstances where there is a combination of bright and dark images on the screen, and the dark images may be sustained for some period of time. Especially in such situations, the conventional way of illuminating the pixels in the LCD 100 may result in waste. In fact, the power consumption of a backlit LCD may account for a large portion of the overall power consumption of any computer. The inefficiencies due to LCD backlighting may lead to reduced battery life, which may be particularly problematic, for example, when playing video games or viewing DVD movies on long airline flights.

Therefore, a need exists in the art for a method and system for reducing the power consumption of backlit LCD displays.

SUMMARY OF THE INVENTION

Embodiments of the present invention provide a method and apparatus for optimizing the brightness of a backlight that illuminates an LCD, thereby reducing the power consumed.

A "source image" comprising pixel data is provided by a processor. Based on the brightness information included in the pixel data, an input to the backlight may be calculated such that the backlight produces a level of brightness that is at least as great as, but not substantially greater than, the brightness of the brightest pixel in the source image. An input to the LCD, the "LCD input image," is used to modify the level of brightness produced by the backlight. The LCD input image may be calculated based on the input to the backlight and the brightness information from the source image. Finally, the brightness of the image produced on the LCD screen, the "viewed image," results from the brightness at each pixel location on the LCD screen being adjusted from the level provided by the backlight to a level controlled by the LCD input image. Ideally, the combination of the backlight brightness and the LCD input image should make the brightness of the viewed image substantially similar to the brightness of the source image.

In another embodiment, multiple backlight segments are provided to account for the fact that there may be significant variation in brightness across the image displayed on the LCD screen. Each backlight segment may be driven to produce a different level of brightness. The LCD input image is determined by considering all the pixels covered by each of the backlights. Further, the brightness level produced by each backlight segment should be at least as great as the brightness of the brightest pixel it covers, while taking into account the fact that some pixels may be illuminated by more than one backlight segment.

Embodiments of the invention, in calculating the input(s) to the backlight(s) and the LCD input image, may also account for any backlight segment that has a known, non-uniform brightness output profile.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 2:
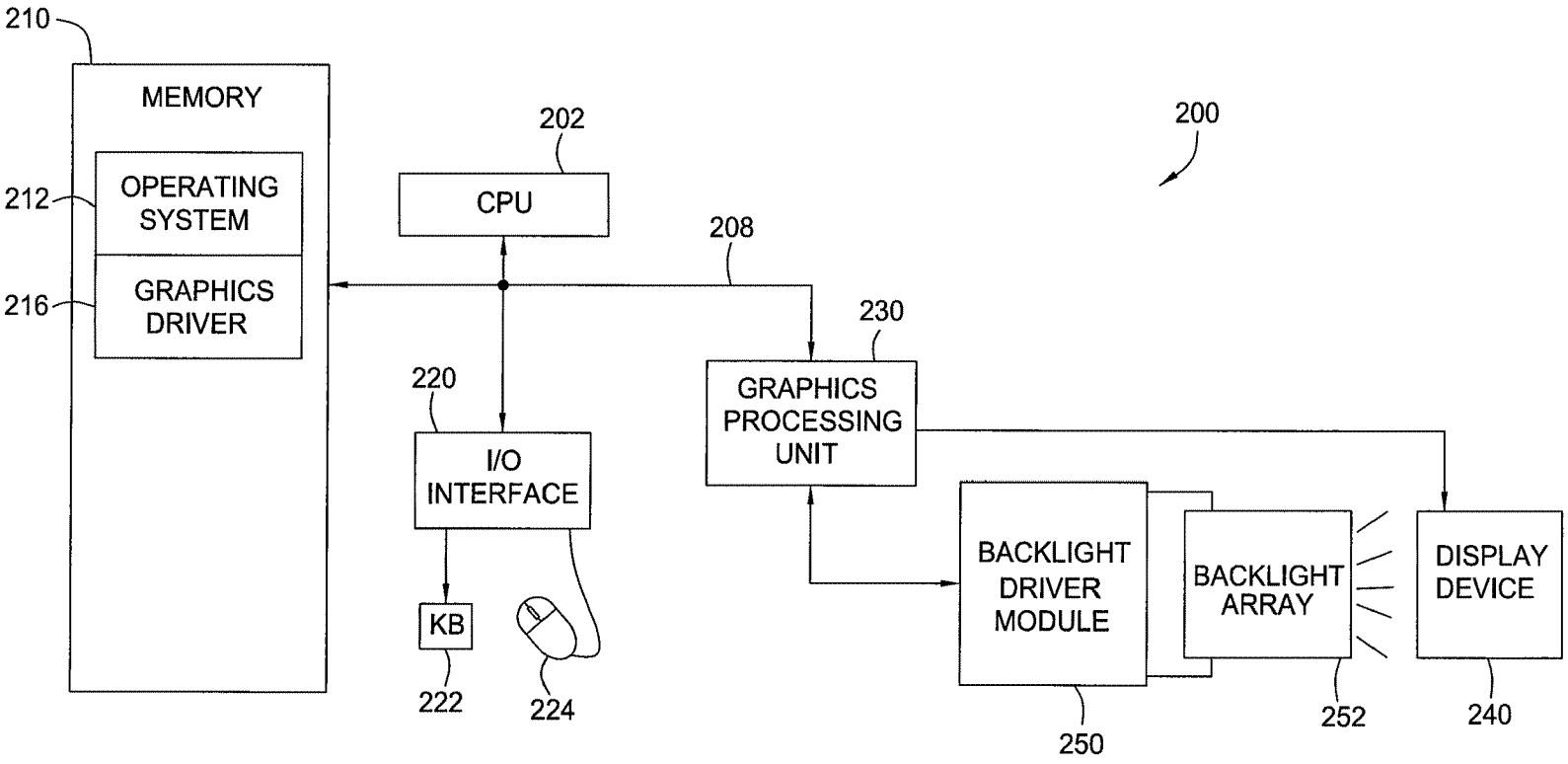
FIG. 2 illustrates a computer system in accordance with one or more embodiments of the invention.

FIG. 2 illustrates a simplified block diagram of a computer system 200 in accordance with one or more embodiments of the invention. Computer system 200 may be a desktop computer, server, laptop computer, palm-sized computer, tablet computer, game console, cellular telephone, computer based simulator, or the like. The computer system 200 includes a central processing unit (CPU) 202 communicably linked to a system (or main) memory 210. The system memory 210 may be one or a combination of memory devices, including random access memory (RAM), nonvolatile or backup memory, such as programmable or flash memories, read-only memories, and the like.

The computer system 200 may also include an input/output (I/O) interface 220, a graphics processing unit (GPU) 230, and a backlight driver module (250). The I/O interface 220 allows the CPU 202 to receive user input from various input devices, such as a keyboard 222 and a mouse 224, via a bus 208. Alternatively, computer system 200 may include a single hardwired component or any combination of programmable components, such as a CPU 202, GPU 230, a video processor (VPU), application processor (APU), or the like.

The GPU 230 is configured to receive graphical information from the CPU 202 via the bus 208 and transform the graphical information into a source image (which comprises pixel data) to be sent to a pixel-based display device 240. Although sometimes referred to herein as an LCD, persons skilled in the art will recognize that the display device 240 may be any type of backlit display device, including, without limitation, a conventional CRT, LCD-based monitor, LCD-based projector or the like. Further, in alternative embodiments of the invention, the source image may be produced by other types of dedicated hardware, CPU 202, programmable hardware, such as a GPU program or a CPU program, or by means external to the computer system 200.

Figure 1:
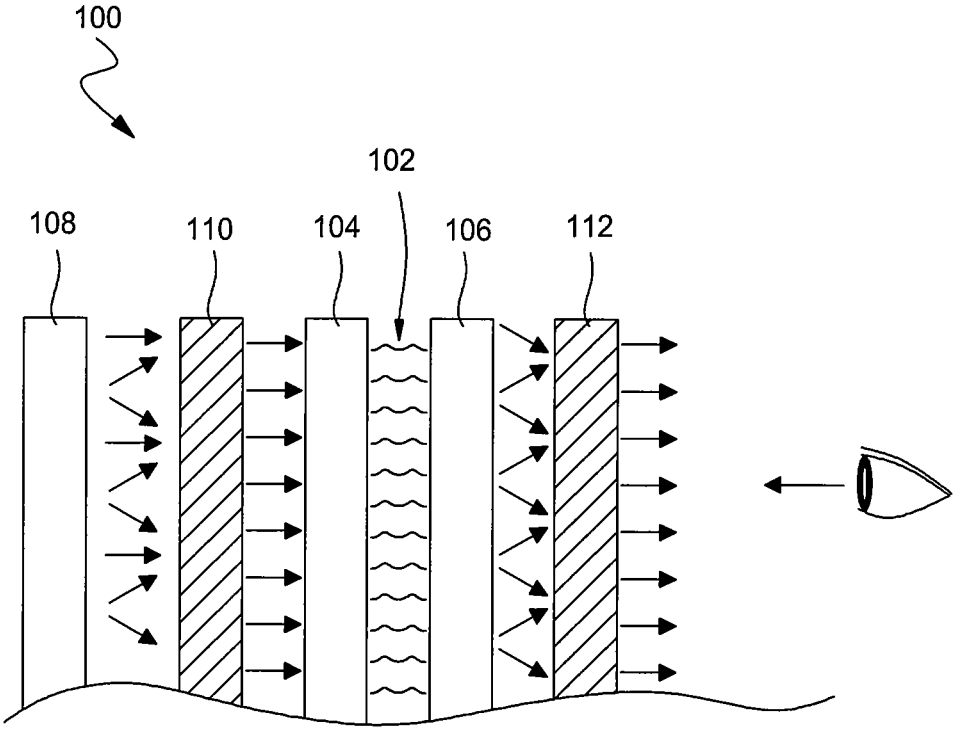
FIG. 1 (PRIOR ART)
FIG. 1 illustrates an exemplary backlit liquid crystal display.

Conventionally, the backlight source operates at a constant brightness to illuminate the pixels of the LCD material. However, the intensity of the backlight need be no greater than is necessary to produce a brightness level that is as great as the brightness of the brightest pixel of the source image. Therefore, pursuant to this invention, the brightness of the backlight can be continuously adjusted based on the brightness bitmap associated with the source image. In addition, to generate the viewed image (i.e., the image produced on the screen of the display device 240), an LCD input image is computed (in one embodiment, by the GPU 230) and used to modify the brightness level at each pixel location on the screen produced by the backlight. The LCD input image comprises a brightness bitmap that is generated based on the input used to control the intensity of the backlight and the brightness information from the source image. The LCD input image controls the LCD material within the display device 240 (as described above in conjunction with FIG. 1) to adjust the brightness at each pixel location on the screen from the level provided by the backlight to a final level. The resulting brightness of each pixel in the viewed image is substantially similar to the brightness assigned to that pixel in the source image.

This process can be extended to account for the fact that the backlight may not have a uniform brightness profile. If the brightness profile is known, it may be combined with the brightness information from the source image in calculating the input to the backlight as well as the LCD input image, as described in further detail below in conjunction with FIG. 4.

The backlight driver module 250 may be used to generate a signal to drive a backlight array 252 used for illuminating the display device 240. According to embodiments of the present invention, the backlight driver module 250 may also be used to adjust the brightness of the backlight array 252 based on the source image, as described in more detail in the following paragraphs.

Figure 3:
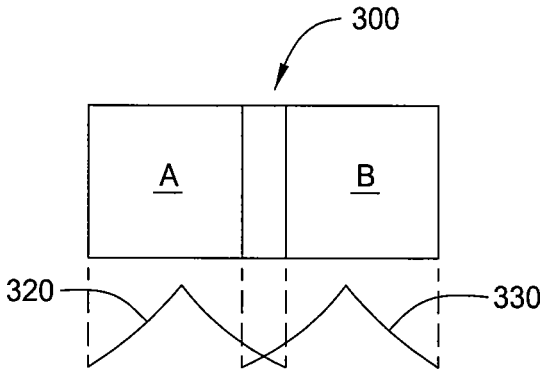
FIG. 3 illustrates a backlight array in accordance with one or more embodiments of the invention.

Referring next to FIG. 3, an especially useful embodiment of the invention includes two or more backlight sources, each source corresponding to a segment in the backlight array 300. In fact, the backlight array 252 of FIG. 2 may include any number of individual backlights configured to illuminate a portion of the display screen having a shape that is rectangular, circular, honeycomb, or the like. It is thus possible to build the backlight array 300 with multiple regions that can be lit at multiple brightnesses. This allows darker areas to be powered down, using less power, rather than using the LCD material within the display device 240 to block out the light in darker areas. For example, in a typical game display, there is oftentimes significant variation in brightness across the screen. Since this variation is coherent, it will be possible to dim entire areas of the backlight, thereby reducing power consumption. As FIG. 3 shows, segment A has a brightness profile 320 and segment B has a brightness profile 330. This configuration introduces the issues of non-uniform intensity across each segment and smooth transitions between backlight segments.

Ideally, the backlight segments overlap smoothly, so that there is no sharp boundary in the viewed image where the light from one segment ends and the other begins. It is also possible to practice this invention with uniform intensity and/or non-overlapping backlight segments, but less desirable. In the case where the backlight intensity is not uniform (due to multiple overlapping segments and/or nonuniform intensity across each segment), the LCD input image must account for the variations in backlight brightness. A method for displaying a viewed image when such nonuniformity in backlight intensity exists is described with respect to FIG. 4. For purposes of discussion only, the backlight array 252 of FIG. 2 is assumed to have the configuration set forth in FIG. 3.

The method begins at step 410 where the source image is generated. At step 420, inputs to the one or more backlight sources within backlight array 300 are computed based on the brightness information from the source image and the brightness profile of each backlight. Specifically, when two backlight sources, A and B, are used, backlight input (IA) for backlight source A and backlight input (IB) for backlight source B are determined. Inputs IA and IB control the illumination provided by backlight source A and B, respectively. Usually, backlight inputs IA and IB are computed so that the brightness level produced by the series of backlight sources A and B is as great as the brightness of the brightest pixel in the area that each such backlight illuminates. In one embodiment, inputs IA and IB for backlights A and B are computed according to the constraint equation:

$$I(x,y)=<IA*\text{Brightness}A(x,y)+IB*\text{Brightness}B(x,y),$$

where I (x, y) is the brightness bitmap associated with the source image expressed as a function of pixel position (on the screen of the display device 240), BrightnessA is the brightness profile of backlight A expressed as a function of pixel position, and BrightnessB is the brightness profile of backlight B as a function of pixel position.

In one embodiment, the values for inputs IA and IB may vary from zero to one. Backlight inputs IA and IB may be computed by CPU 202, GPU 230 or other dedicated hardware or programmable hardware, such as a CPU program or a GPU program. In alternative embodiments where the backlight array includes a single backlight source, the above constraint equation is simplified accordingly. Similarly, in alternative embodiments where the backlight array includes more than two backlight sources, the above constraint equation includes a term for each backlight source.

As previously described, unlike conventional backlights, backlight array 300 does not provide a uniform illumination across the display surface. Because the backlight array is more intricate (it has multiple backlights, which may have different brightness profiles), the LCD input image has to be adjusted accordingly. At step 430, the LCD input image is computed based on the brightness information from the source image, the input to each backlight source in the backlight array and the brightness profile of each backlight source. In one embodiment of the invention, the LCD input image, L (x, y), is computed according to the equation:

$$L(x,y)=I(x,y)/(IA*\text{Brightness}A(x,y)+IB*\text{Brightness}B(x,y)).$$

The LCD input image is configured to be used as an input to the display device 240. Like the backlight inputs, the LCD input image may be computed by CPU 202, GPU 230 or other dedicated hardware or programmable hardware, such as a CPU program or a GPU program.

At step 440, the backlight inputs, IA and IB, are transmitted to the backlight driver module 250, and the LCD input image, L (x, y), is forwarded to the display device 240. As previously described herein, the display device 240 combines two inputs, the light produced from the backlight array 300 and the LCD input image, to produce the viewed image. Specifically, the LCD input image is configured to attenuate, at each pixel location on the screen of the display device 240, the brightness associated with the light produced from the backlight array 300. This attenuation produces a viewed image having an associated brightness bitmap that is substantially equal to the brightness bitmap associated with the source image.

One advantage of the disclosed systems and methods is that the brightness associated with the light produced from the backlight may be adjusted according to the source image generated by the GPU 230. As such, the power consumed by the backlights in the backlight array varies according to each source image generated by the GPU 230, as opposed to remaining constant for all source images, as is the case with conventional systems. Thus, implementing the systems and methods described herein may substantially reduce the overall power consumption of computer system 200.

Figure 4:
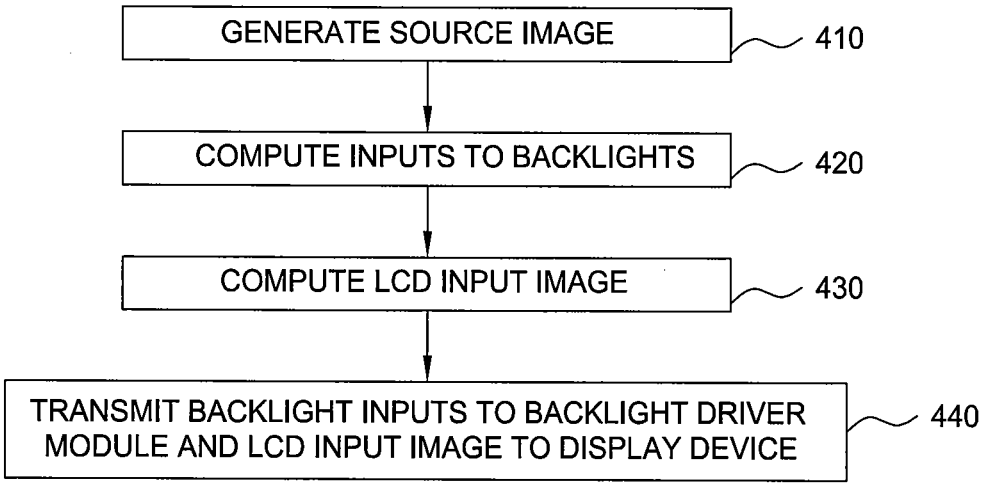
FIG. 4 illustrates a flow diagram of a method for generating a viewed image in accordance with one or more embodiments of the invention.

At some pixel positions (e.g., those on the left side of the region illuminated by backlight A in FIG. 3 and those of the right side of the region illuminated by backlight B), the algorithm of FIG. 4 has to contend with only one backlight brightness profile. However, at other pixel positions (e.g., those in the region illuminated by both backlights A and B), the algorithm has to contend with both backlight brightness profiles. An interesting point about the mathematics is that the algorithm works regardless of the number of overlapping brightness profiles since the algorithm contemplates a weighted superposition of the equations describing the individual brightness profiles of each backlight in the backlight array.

One or more embodiments of the invention described above may be implemented as a program product for use with a computer system such as, for example, the computer system 200 shown in FIG. 2. The program product may include a program which, when executed by the CPU 202, performs functions of one or more embodiments of the invention described herein. The program product can be contained on a variety of signal-bearing media, including, but not limited to, non-writeable storage media (e.g., read-only memory devices, such as CD-ROM disks), alterable information stored on writable storage media (e.g., floppy disks, CD-RAN disks), or information conveyed to a computer by a communications medium, such as a computer network, telephone network, or wireless network, including the Internet.

While the foregoing is directed to embodiments of the present invention, other and further embodiments of the invention may be devised without departing from the basic scope thereof, and the scope thereof is determined by the claims that follow.

What is claimed is:

1. A method for displaying a display image on a backlit display device, the method comprising:

generating a source image comprised of a plurality of pixels, wherein each pixel in the source image has an associated initial brightness level;

determining a first backlight input for a first backlight that illuminates pixels of the display device and a second backlight input for a second backlight that illuminates pixels of the display device based on a first brightness profile, a second brightness profile, and the source image, wherein the first brightness profile comprises a mapping of non-uniform brightness of the first backlight as a function of pixel position and wherein the second brightness profile comprises a mapping of non-uniform brightness of the second backlight as a function of pixel position;

modifying a first intensity of the first backlight and a second intensity of the second backlight based on the first backlight input and the second backlight input; and computing an LCD input image that is based on the first backlight input, the second backlight input, the first brightness profile, the second brightness profile, and the source image.

2. The method of claim 1, wherein the LCD input image is based on a first brightness bitmap associated with the source image.

3. The method of claim 1, wherein:

each pixel in the source image has a pixel position, and determining the first backlight input and the second backlight input further comprises determining the first backlight input and the second backlight input such that, for each pixel in the source image, the initial brightness level of the pixel is less than or equal to the sum of the first backlight input multiplied by a brightness level in the first brightness profile corresponding to the pixel position and the second backlight input multiplied by a brightness level in the second brightness profile corresponding to the pixel position.

4. The method of claim 3, wherein the first backlight input and the second backlight input are computed so that the brightness level produced by the first backlight and the second backlight is as great as the greatest initial brightness level associated with the pixels in the source image.

5. The method of claim 3, wherein the first backlight input ranges from zero to approximately one and the second backlight input ranges from zero to approximately one.

6. The method of claim 1, wherein:

the LCD input image has a plurality of pixels, each having a pixel position; and computing the LCD input image further comprises calculating a value for each pixel in the LCD input image as equal to the initial brightness level of the pixel in the source image divided by the sum of the first backlight input multiplied by a first brightness level in the first brightness profile corresponding to the pixel position of the pixel and the second backlight input multiplied by a second brightness level in the second brightness profile corresponding to the pixel position of the pixel, wherein the first brightness level is different from the second brightness level.

7. The method of claim 6, wherein the backlight comprises first, second, and third segments, and the method further comprises the step of determining a third backlight input.

8. A non-transitory computer-readable medium storing instructions that, when executed by a processor, cause a computer system to display a display image on a backlit display device, by performing the steps of:

generating a source image comprised of a plurality of pixels, wherein each pixel in the source image has an associated initial brightness level;

determining a first backlight input for a first backlight that illuminates pixels of the display device and a second backlight input for a second backlight that illuminates pixels of the display device based on a first brightness profile, a second brightness profile, and the source image, wherein the first brightness profile comprises a mapping of non-uniform brightness of the first backlight as a function of pixel position and wherein the second brightness profile comprises a mapping of non-uniform brightness of the second backlight as a function of pixel position;

modifying a first intensity of the first backlight and a second intensity of the second backlight based on the first backlight input and the second backlight input; and computing an LCD input image that is based on the first backlight input, the second backlight input, the first brightness profile, the second brightness profile, and the source image.

9. The non-transitory computer-readable medium of claim 8, wherein the LCD input image is based on a first brightness bitmap associated with the source image.

10. The non-transitory computer-readable medium of claim 8, wherein:

each pixel in the source image has a pixel position, and determining the first backlight input and the second backlight input further comprises determining the first backlight input and the second backlight input such that, for each pixel in the source image, the initial brightness level of the pixel is less than or equal to the sum of the first backlight input multiplied by a brightness level in the first brightness profile corresponding to the pixel position and the second backlight input multiplied by a brightness level in the second brightness profile corresponding to the pixel position.

11. The non-transitory computer-readable medium of claim 10, wherein the first backlight input and the second backlight input are computed so that the brightness level produced by the first backlight and the second backlight is as great as the greatest initial brightness level associated with the pixels in the source image.

12. The non-transitory computer-readable medium of claim 10, wherein the first backlight input ranges from zero to approximately one and the second backlight input ranges from zero to approximately one.

13. The non-transitory computer-readable medium of claim 8, wherein:

the LCD input image has a plurality of pixels, each having a pixel position; and computing the LCD input image further comprises calculating a value for each pixel in the LCD input image as equal to the initial brightness level of the pixel in the source image divided by the sum of the first backlight input multiplied by a first brightness level in the first brightness profile corresponding to the pixel position of the pixel and the second backlight input multiplied by a second brightness level in the second brightness profile corresponding to the pixel position of the pixel, wherein the first brightness level is different from the second brightness level.

14. The non-transitory computer-readable medium of claim 13, wherein the backlight comprises first, second, and third segments, and the method further comprises the step of determining a third backlight input.

15. A system for displaying a display image, comprising:

a display device; and one or more processors configured to carry out the steps of:

generating a source image comprised of a plurality of pixels, wherein each pixel in the source image has an associated initial brightness level, determining a first backlight input for a first backlight that illuminates pixels of the display device and a second backlight input for a second backlight that illuminates pixels of the display device based on a first brightness profile, a second brightness profile, and the source image, wherein the first brightness profile comprises a mapping of non-uniform brightness of the first backlight as a function of pixel position and wherein the second brightness profile comprises a mapping of non-uniform brightness of the second backlight as a function of pixel position, modifying a first intensity of the first backlight and a second intensity of the second backlight based on the first backlight input and the second backlight input, and computing an LCD input image that is based on the first backlight input, the second backlight input, the first brightness profile, the second brightness profile, and the source image.

16. The system of claim 15, wherein:

each pixel in the source image has a pixel position, and determining the first backlight input and the second backlight input further comprises determining the first backlight input and the second backlight input such that, for each pixel in the source image, the initial brightness level of the pixel is less than or equal to the sum of the first backlight input multiplied by a brightness level in the first brightness profile corresponding to the pixel position and the second backlight input multiplied by a brightness level in the second brightness profile corresponding to the pixel position.

17. The system of claim 16, wherein the first backlight input and the second backlight input are computed so that the brightness level produced by the first backlight and the second backlight is as great as the greatest initial brightness level associated with the pixels in the source image.

18. The system of claim 16, wherein the first backlight input ranges from zero to approximately one and the second backlight input ranges from zero to approximately one.

19. The system of claim 15, wherein:

the LCD input image has a plurality of pixels, each having a pixel position; and computing the LCD input image further comprises calculating a value for each pixel in the LCD input image as equal to the initial brightness level of the pixel in the source image divided by the sum of the first backlight input multiplied by a first brightness level in the first brightness profile corresponding to the pixel position of the pixel and the second backlight input multiplied by a second brightness level in the second brightness profile corresponding to the pixel position of the pixel, wherein the first brightness level is different from the second brightness level.

20. The system of claim 19, wherein the backlight comprises first, second, and third segments, and the one or more processors are further configured to determine a third backlight input.

21. The method of claim 1, wherein the mapping of the first backlight and the mapping of the second backlight overlap for at least one pixel position.

* * * * *